US010626754B2

(12) United States Patent
Hashimoto et al.

(10) Patent No.: US 10,626,754 B2
(45) Date of Patent: Apr. 21, 2020

(54) COMPRESSION DEVICE

(71) Applicant: Kobe Steel, Ltd., Hyogo (JP)

(72) Inventors: Koichiro Hashimoto, Takasago (JP); Kazumasa Nishimura, Takasago (JP); Shigeto Adachi, Takasago (JP); Yutaka Narukawa, Takasago (JP); Haruyuki Matsuda, Kobe (JP); Tetsuya Kakiuchi, Takasago (JP); Noboru Tsuboi, Hyogo (JP); Kazunori Fukuhara, Takasago (JP)

(73) Assignee: Kobe Steel, Ltd., Hyogo (JP)

( * ) Notice: Subject to any disclaimer, the term of this patent is extended or adjusted under 35 U.S.C. 154(b) by 417 days.

(21) Appl. No.: 15/327,098

(22) PCT Filed: Jul. 6, 2015

(86) PCT No.: PCT/JP2015/069400
§ 371 (c)(1),
(2) Date: Jan. 18, 2017

(87) PCT Pub. No.: WO2106/027576
PCT Pub. Date: Feb. 25, 2016

(65) Prior Publication Data

US 2017/0159660 A1 Jun. 8, 2017

(30) Foreign Application Priority Data

Aug. 21, 2014 (JP) ..... 2014-168559

(51) Int. Cl.
*F25B 25/00* (2006.01)
*F01K 23/08* (2006.01)
(Continued)

(52) U.S. Cl.
CPC ..... *F01K 23/08* (2013.01); *F25B 11/02* (2013.01); *F25B 9/06* (2013.01); *F25B 25/005* (2013.01); *F25B 2500/01* (2013.01)

(58) Field of Classification Search
CPC ..... F25B 25/0058; F25B 11/02; F25B 9/06; F25B 2500/01; F25B 25/005; F01K 23/05; F01K 23/08
See application file for complete search history.

(56) References Cited

U.S. PATENT DOCUMENTS 4,342,201 A 8/1982 Ishii
6,260,373 B1 * 7/2001 Rockwood ..... F16F 7/1028 165/69

(Continued)

FOREIGN PATENT DOCUMENTS

CN 101194084 A 6/2008
JP S56-115896 A 9/1981

(Continued)

OTHER PUBLICATIONS

International Search Report issued in PCT/JP2015/069400; dated Oct. 6, 2015.

(Continued)

*Primary Examiner* — David J Teitelbaum
(74) *Attorney, Agent, or Firm* — Studebaker & Brackett PC

(57) ABSTRACT

A compression device is equipped with a compressor (102) and a heat energy recovery unit (200) that recovers heat energy from a compressed gas. The heat energy recovery unit (200) is equipped with: a heat exchanger (202) that has an inflow port (202*a*), and that heats an operating medium by means of the heat from the compressed gas; an expansion device (210); a power recovery unit (212); a condenser (214); and a pump (222). The heat exchanger (202) is arranged closer to the compressor (102) than the expansion (Continued)

device (210), and is oriented such that the inflow port (202*a*) faces the compressor (102).

14 Claims, 9 Drawing Sheets

(51) Int. Cl.
*F25B 11/02* (2006.01)
*F25B 9/06* (2006.01)

(56) References Cited

U.S. PATENT DOCUMENTS

| | | | | |
|---|---|---|---|---|
| 2007/0074535 | A1* | 4/2007 | Holdsworth ..... | F04C 18/16 62/501 |
| 2009/0188253 | A1 | 7/2009 | Smith et al. | |
| 2012/0312009 | A1 | 12/2012 | Smith et al. | |
| 2014/0174087 | A1 | 6/2014 | Mizoguchi et al. | |

FOREIGN PATENT DOCUMENTS

| | | | |
|---|---|---|---|
| JP | H04-244697 | A | 9/1992 |
| JP | H05-025190 | U | 4/1993 |
| JP | 2811975 | B2 | 10/1998 |
| JP | H10-281599 | A | 10/1998 |
| JP | 2013-057256 | A | 3/2013 |
| JP | 2013-076373 | A | 4/2013 |

OTHER PUBLICATIONS

Written Opinion issued in PCT/JP2015/069400; dated Oct. 6, 2015.
Extended European Search Report (EESR) dated Jan. 3, 2018, from corresponding EP Appl No. 15833111.6, 7 pp.

* cited by examiner

COMPRESSION DEVICE

TECHNICAL FIELD

The present invention relates to a compression device.

BACKGROUND ART

A system for recovering heat energy included in compressed gas that has been discharged from a compressor has been recently proposed. For example, Patent Document 1 discloses an energy recovery system of a compression device including: a compressor; an evaporator for conducting heat exchange between compressed gas that has been discharged from the compressor and a liquid-phase working medium; a cooler for cooling the gas that has flowed out from the evaporator; a turbine in which the gas-phase working medium that has flowed out from the evaporator flows; an AC generator connected to the turbine; a condenser for condensing the working medium that has flowed out from the turbine; and a circulating pump for pumping the liquid-phase working medium that has flowed out from the condenser, to the evaporator. In this system, energy included in the compressed gas is recovered in the evaporator and by using the energy, electric power generation is performed in the AC generator.

In the system disclosed in the foregoing Patent Document 1, a pressure loss is desired to be reduced as much as possible so that pressure of the compressed gas discharged from the compressor may be a desired value. However, since the evaporator is provided, a pressure loss of the compressed gas in a flow passage may increase. Therefore, in order to maintain the pressure of the compressed gas, power of the compressor needs to be increased. As a result, heat energy, which is to be effectively recovered in the energy recovery system may decrease. Note that nothing has been mentioned in Patent Document 1 about a means for reducing a pressure loss.

CITATION LIST

Patent Document

Patent Document 1: JP 2013-057256 A

SUMMARY OF THE INVENTION

An object of the present invention is to provide a compression device that can achieve an effective recovery of heat energy included in compressed gas and a reduction of a pressure loss of the compressed gas.

A compression device according to an aspect of the present invention includes: a compressor for compressing gas; and a heat energy recovery unit for recovering heat energy of the gas that has been compressed in the compressor and discharged therefrom, the heat energy recovery unit including: a heat exchanger having an inflow port for allowing inflow of the compressed gas, the heat exchanger for heating a working medium by heat of the compressed gas; an expansion device for expanding the working medium that has flowed out from the heat exchanger; a power recovery unit connected to the expansion device; a condenser for condensing the working medium that has flowed out from the expansion device; and a pump for pumping the working medium that has flowed out from the condenser, to the heat exchanger, wherein the heat exchanger is positioned closer to the compressor than the expansion device and is arranged so that the inflow port is oriented to face the compressor.

DESCRIPTION OF EMBODIMENTS

A compression device according to an embodiment of the present invention will be described with reference to FIG. 1 to FIG. 3.

Figure 1:
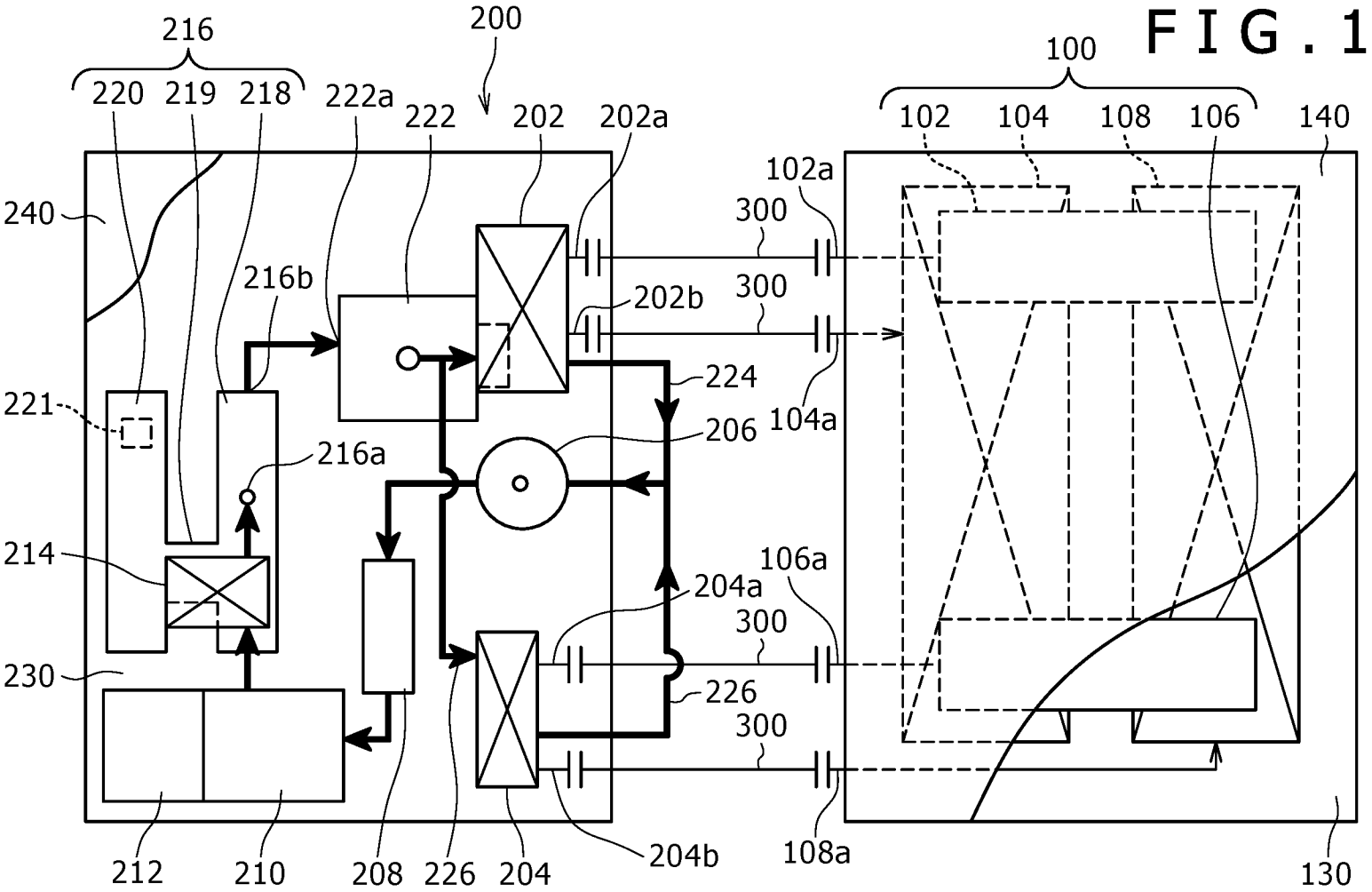
FIG. 1 is a plan view of a compression device according to an embodiment of the present invention.

As shown in FIG. 1, the compression device includes a compression device body 100 and a heat energy recovery unit 200.

The compression device body 100 includes a first compressor 102 for compressing gas (for example, air), a first cooler 104, a second compressor 106 for further compressing the compressed gas that has flowed out from the first cooler 104, and a second cooler 108.

The first compressor 102 is a screw compressor. Specifically, the first compressor 102 includes a compressor body, a motor, and a power transmission device for transmitting power of the motor to the compressor body. The compressor body includes a screw rotor, a housing that houses the screw rotor, and a discharge section for discharging the compressed gas. The screw rotor is formed by a rotor shaft as a rotary shaft and a screw (compression member) that is rotatable along with the rotor shaft. The first compressor 102 is arranged so that the rotor shaft is horizontally oriented. In addition, the first compressor 102 is not limited to the screw compressor and may be a compressor that includes a rotary shaft for driving a compression member; in other words, the compressor may be a turbo compressor or a scroll compressor.

The second compressor 106 is a screw compressor. The structure of the second compressor 106 being the same as that of the first compressor 102 includes a compressor body, a motor, and a power transmission device for transmitting power of the motor to the compressor body. Note that a single motor and a single power transmission device may be used in common by the first compressor 102 and the second compressor 106. The second compressor 106 is arranged so that a rotor shaft of a screw rotor is horizontally oriented and so that the rotor shaft thereof is oriented parallel to the rotor shaft of the first compressor 102. Furthermore, the second compressor 106 is not limited to the screw compressor and may be a turbo compressor or a scroll compressor.

The first cooler 104 is configured to cool the compressed gas that has been discharged from the first compressor 102 and subsequently passed through a first heat exchanger 202, which will be described below, but has not yet flowed in the second compressor 106. The second cooler 108 is configured to cool the compressed gas that has been discharged from the second compressor 106 and subsequently passed through a second heat exchanger 204, which will be described below, but has not yet been supplied to the outside. Flow passages of the compressed gas between the first cooler 104 and the second compressor 106 and between the second cooler 108 and the outside are not shown in FIG. 1, and likewise, the flow passages are not shown in the following FIG. 4 and FIG. 6. These coolers 104, 108 are arranged below the first compressor 102 and the second compressor 106, respectively.

In the present embodiment, as shown in FIG. 1, the compression device body 100 is arranged on a first base plate 130 of a substantially rectangular shape. Specifically, the first cooler 104 and the second cooler 108 are directly placed on an upper surface of the first base plate 130, and the first compressor 102 and the second compressor 106 are arranged above the both coolers 104, 108; in other words, the compressors are positioned above and separated from the upper surface of the first base plate 130. In this application, not only the aspect where each of the devices is directly placed on the upper surface of the first base plate 130 but also the aspect where each of the devices is positioned above and separated from the upper surface of the first base plate 130 will be described as follows. "The device is arranged on the first base plate 130". The same description applies to the aspect of a second base plate 230, which will be described below.

The compression device body 100 is covered by a first cover 140 while being arranged on the first base plate 130. Note that FIG. 1 shows a partially cut-away view of the first cover 140.

Next, the heat energy recovery unit 200 will be described with reference to FIG. 1 and FIG. 2. The heat energy recovery unit 200 is a so-called binary system, which utilizes an Organic Rankine Cycle, and the unit includes the first heat exchanger 202, the second heat exchanger 204, an oil separator 206, an urgent shut-off valve 208, an expansion device 210, a generator 212 that is a power recovery unit 212 connected to the expansion device 210, a condenser 214, a receiver 216, a pump 222, and a circulating flow passage 224.

The circulating flow passage 224 establishes a connection from the first heat exchanger 202 through the oil separator 206, the urgent shut-off valve 208, the expansion device 210, the condenser 214, and the receiver 216 to the pump 222 in the mentioned order and a connection from the second heat exchanger 204 through the oil separator 206, the urgent shut-off valve 208, the expansion device 210, the condenser 214, and the receiver 216 to the pump 222 in the mentioned order. A working medium (organic fluid such as R245fa having a boiling point lower than that of water) circulates through the circulating flow passage 224.

The circulating flow passage 224 includes a branch flow passage 226. The branch flow passage 226 branching from a portion of the circulating flow passage 224, which is located between the pump 222 and the first heat exchanger 202 in the circulating flow passage 224, is connected to the second heat exchanger 204. In the circulating flow passage 224, the first heat exchanger 202 and the second heat exchanger 204 are arranged in parallel with each other.

The first heat exchanger 202 includes an inflow port **202*a* for allowing inflow of the compressed gas that has been compressed in the first compressor 102. The working medium is heated by heat of the compressed gas that has flowed through the inflow port 202*a* into the first heat exchanger. In other words, the compressed gas is cooled by the working medium. The first heat exchanger 202 is a so-called finned tube heat exchanger. Note that a plate heat exchanger may be used as the first heat exchanger 202, and likewise, a plate heat exchanger may be used as the second heat exchanger 204**.

The second heat exchanger 204 includes an inflow port **204*a* for allowing inflow of the compressed gas that has been compressed in the second compressor 106. The working medium is heated by heat of the compressed gas that has flowed through this inflow port 204*a*** into the second heat exchanger. In other words, the compressed gas is cooled by the working medium.

The oil separator 206 provided downstream of the first heat exchanger 202 and the second heat exchanger 204 is configured to separate oil included in the working medium that has flowed out from the both heat exchangers 202, 204. In the present embodiment, the oil is used, for example, for lubricating various components of the expansion device 210 or the pump 222.

The expansion device 210 is provided downstream of the oil separator 206. In the present embodiment, a volumetric screw expansion device is applied as the expansion device 210. This expansion device 210 includes: a casing that is internally provided with a rotor chamber; and a pair of male and female screw rotors that are rotatably supported in the rotor chamber. The gas-phase working medium that has flowed in the rotor chamber expands, thereby rotating the screw rotors. Note that the expansion device 210 is not limited to the screw expansion device, and alternatively, a centrifugal expansion device or a scroll expansion device may be applied.

The generator 212 is connected to the expansion device 210. This generator 212 includes a rotary shaft that is connected at least one of the pair of screw rotors of the expansion device 210. The rotary shaft rotates along with rotation of the screw rotor; thereby, the generator 212 generates electric power.

The condenser 214 provided downstream of the expansion device 210 is configured to cool the working medium with cooling fluid (such as cooling water), which is to be supplied from the outside, thereby condensing the working medium (forming the working medium into liquid-phase).

The receiver 216 provided downstream of the condenser 214 is configured to store the liquid-phase working medium that has flowed out from the condenser 214. As shown in FIG. 1 and FIG. 2, the receiver 216 has a substantially H-shape in planar view. Specifically, the receiver 216 includes: a first tubular portion 218 and a second tubular portion 220 that are arranged in a horizontal surface; and a communication tubular portion 219 that allows communication between the first tubular portion 218 and the second tubular portion 220. Note that the communication tubular portion 219 is connected to respective axial ends of the both tubular portions 218, 220 and the receiver 216 may therefore be formed in a substantially U-shape in planar view. The first tubular portion 218 is provided with an inflow port **216*a* for allowing the liquid-phase working medium that has flowed out from the condenser 214, to flow in the first tubular portion 218. The first tubular portion 218 is provided with an outflow port 216***b* for allowing the liquid-phase working medium to flow out from the first tubular portion 218. The second tubular portion 220 is provided with a liquid level sensor 221 for detecting the liquid level of the working medium. The liquid level sensor 221 and the working medium inflow port 216*a* are separated from each other via the communication tubular portion 219. Therefore, a detected value by the liquid level sensor 221 may be inhibited from changing due to fluctuations in a liquid surface within the first tubular portion 218, which are caused when the working medium has flowed through the inflow port 216*a* into the first tubular portion 218 to impact against the liquid surface.

The pump 222 is provided downstream of the receiver 216 (at a location that is downstream of the receiver 216 in the circulating flow passage 224 and that is upstream of a connected portion of the circulating flow passage 224 with the branch flow passage 226). The pump 222 pressurizes the liquid-phase working medium to a predetermined pressure to send the working medium to the first heat exchanger 202 and the second heat exchanger 204. The pump 222 includes: a suction port 222*a* for allowing the liquid-phase working medium to flow in the pump; and an oil supply port 222*b* for allowing the oil to flow in the pump. An oil supply flow passage 223 (see FIG. 2) for supplying the oil that has been separated from the working medium in the oil separator 206, to the pump 222 is connected to the oil supply port 222*b*. A centrifugal pump provided with an impeller as a rotor, a gear pump including a rotor which is formed by a pair of gears, a screw pump, a trochoid pump, or the like is applied as the pump 222.

Figure 2:
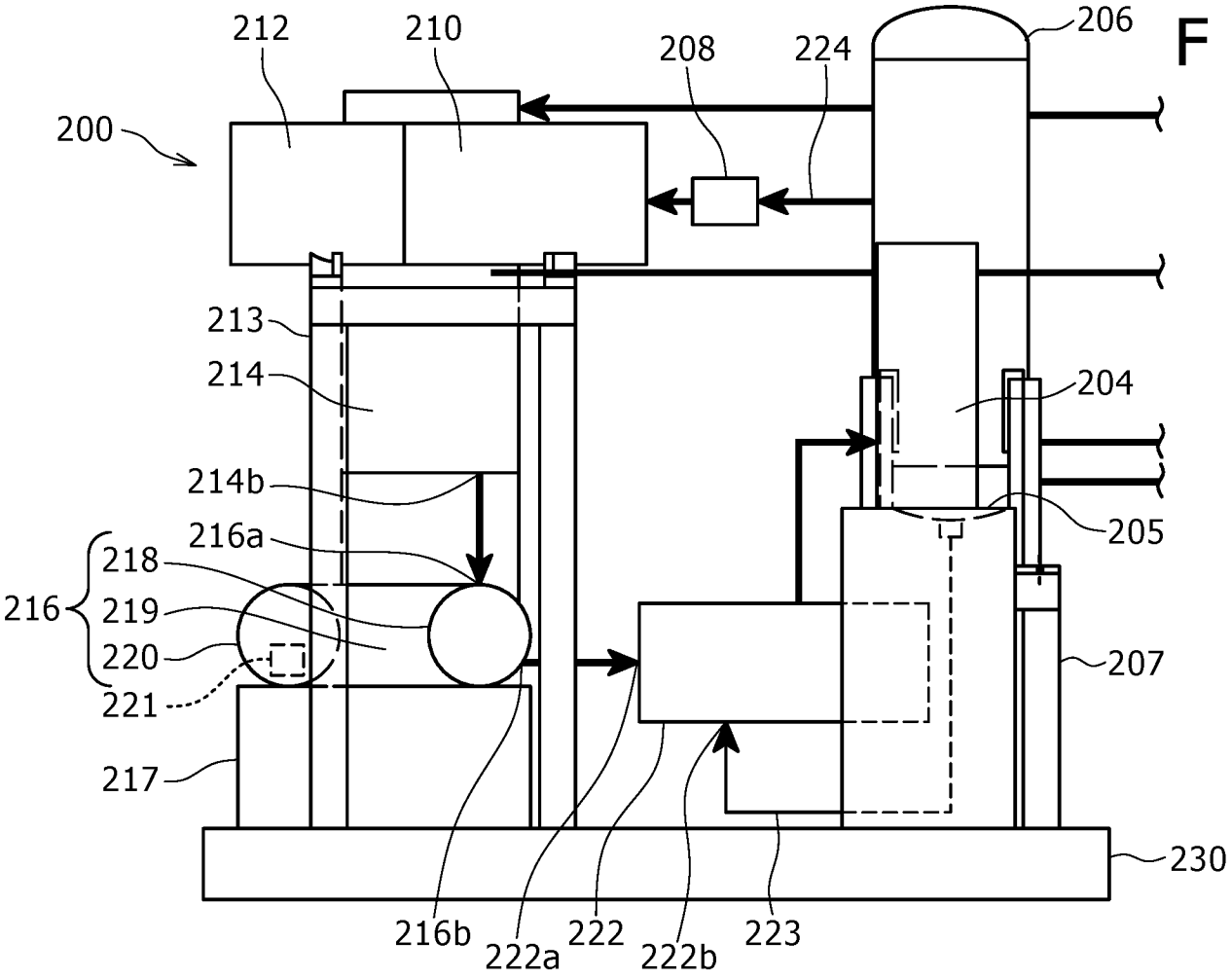
FIG. 2 is a front view of a heat energy recovery unit and a second base plate.

In the present embodiment, as shown in FIG. 1 and FIG. 2, the heat energy recovery unit 200 is arranged on the second base plate 230 of a rectangular shape. Note that FIG. 1 shows a state where the first base plate 130 and the second base plate 230 are separated from each other but as shown in FIG. 3, these base plates are actually in contact with each other.

Next, the arrangement of the heat energy recovery unit 200 on the second base plate 230 will be described.

The first heat exchanger 202 is arranged on one of two opposite corner portions of the second base plate 230, which are positioned so as to face the first base plate 130 (the first heat exchanger 202 is arranged on the upper right corner in FIG. 1). In planar view, the first heat exchanger 202 is arranged so that the inflow port 202*a* is oriented to face a compressed gas discharge port 102*a* of the first compressor 102. Here, the discharge port 102*a* of the first compressor 102 is an opening that is positioned at an end of a flow passage extending from a compression space, which accommodates the screw (compression member), to the downstream side. A discharge port 106*a* of the second compressor 106 has the opening similar to that of the discharge port 102*a*.

In addition, a direction into which the inflow port 202*a* of the first heat exchanger 202 is opened (a direction that is perpendicular to a face including the opening) is substantially in parallel with a direction in which the rotor shaft of the first compressor 102 extends. The first heat exchanger 202 is arranged by using a mounting stand (not shown) so as to be positioned above and separated from an upper surface of the second base plate 230.

The second heat exchanger 204 is arranged on the other one of the foregoing two opposite corner portions of the second base plate 230 (the second heat exchanger 204 is arranged on the lower right corner in FIG. 1). In planar view, the second heat exchanger 204 is arranged so that the inflow port 204*a* is oriented to face the compressed gas discharge port 106*a* of the second compressor 106. A direction into which the inflow port 204*a* of the second heat exchanger 204 is opened (a direction that is perpendicular to a face including the opening) is substantially in parallel with a direction in which the rotor shaft of the second compressor 106 extends. As shown in FIG. 2, the second heat exchanger 204 is arranged by using a mounting stand 205 so as to be positioned above and separated from the upper surface of the second base plate 230.

The oil separator 206 is arranged between the foregoing two opposite corner portions of the second base plate 230. As shown in FIG. 2, the oil separator 206 is arranged by using a mounting stand 207 so as to be positioned above and separated from the upper surface of the second base plate 230.

The expansion device 210 is arranged on one of four corner portions of the second base plate 230, which is a different corner portion from the foregoing two opposite corner portions (the expansion device 210 is arranged on the lower left corner in FIG. 1). As shown in FIG. 2, the expansion device 210 is arranged by using a mounting stand 213 so as to be positioned above and separated from the upper surface of the second base plate 230. The condenser 214 is arranged at a position adjacent to the expansion device 210.

As shown in FIG. 2, the receiver 216 is arranged below the condenser 214. Specifically, the inflow port 216*a* of the receiver 216 is arranged below an outflow port 214*b* (opening for allowing the liquid-phase working medium to flow out) of the condenser 214 in the gravity direction. Thus, the working medium that has flowed out from the condenser 214 can be effectively stored in the receiver 216. Note that if the inflow port 216*a* of the receiver 216 is arranged below the outflow port 214*b* of the condenser 214 in the gravity direction, the inflow port 216*a* may be positioned so as to overlap the outflow port 214*b* in the gravity direction. Alternatively, the inflow port 216*a* may be positioned below the outflow port 214*b* and separated from the outflow port 214*b* in the horizontal direction so as not to overlap the outflow port 214*b* in the gravity direction. The receiver 216 is mounted on a support table 217, thereby being arranged to be positioned above and separated from the upper surface of the second base plate 230.

The pump 222 is arranged at the lateral side of the receiver 216. As shown in FIG. 2, the suction port 222*a* of the pump 222 is located on the same level as the outflow port 216*b* of the receiver 216 in the gravity direction. Accordingly, since the suction port 222*a* of the pump 222 is filled with the liquid-phase working medium, the inflow of gas into the pump 222 is inhibited. Furthermore, a portion of the receiver 216, which is located lower in the gravity direction than the suction port 222*a* of the pump 222 is reduced (it is difficult for the working medium to be suctioned from the portion by the pump 222); therefore, a total volume of the working medium to be stored in the receiver 216 can be reduced.

As shown in FIG. 2, the pump 222 is positioned above and separated from the second base plate 230 by using a mounting stand (not shown) and is arranged so that the oil supply port 222*b* is oriented downward, and the oil supply flow passage 223 is connected to the oil supply port 222*b* while being located below the pump 222.

Figure 3:
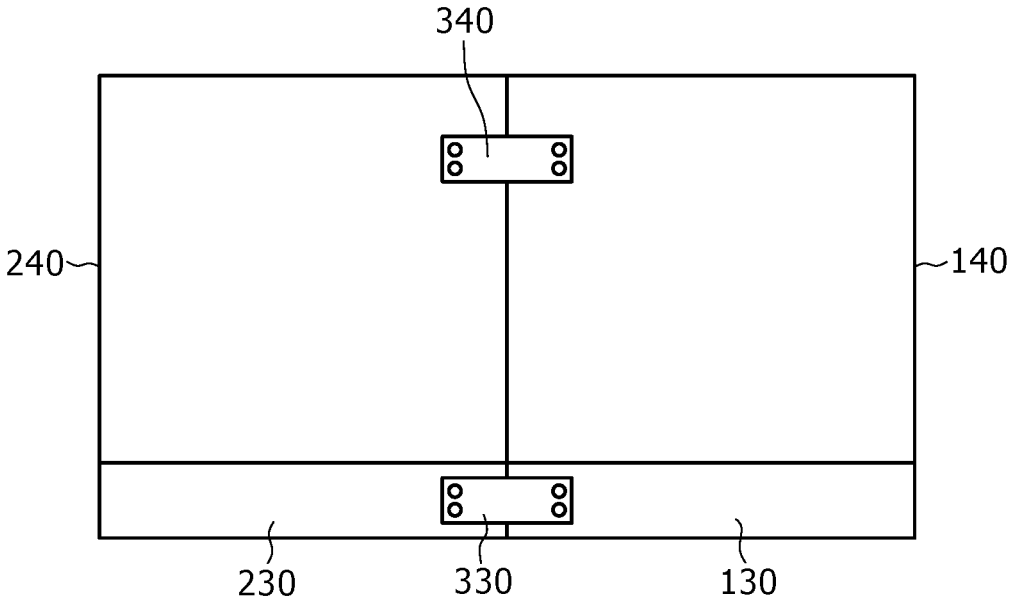
FIG. 3 is a side view of the compression device shown in FIG. 1.

The heat energy recovery unit 200 is covered by a second cover 240, which is shown in FIG. 3, while being arranged on the second base plate 230. Note that FIG. 1 shows a partially cut-away view of the second cover 240.

The compression device is provided with a base plate fixing member 330 by which the first base plate 130 and the second base plate 230 are positionally fixed relative to each other. In the present embodiment, the base plate fixing member 330 includes a flat plated fixing panel and fixtures such as bolts, which enable the fixing panel to be fixed to the both base plates 130, 230. In the compression device, in the case of connecting the heat energy recovery unit 200 to each of the compressors 102, 106, the first base plate 130 and the second base plate 230 are fixed in advance by the base plate fixing member 330; thereby, misalignment of the inflow port 202*a* of the heat exchanger 202 to the discharge port 102*a* of the compressor 102 and misalignment of the inflow port 204*a* of the heat exchanger 204 to the discharge port 106*a* of the compressors 106 are prevented.

The first cover 140 and the second cover 240 are fixed by a cover fixing member 340 in a state where the first cover 140 and the second cover 240 are positionally fixed relative to each other. In the present embodiment, the cover fixing member 340 includes a flat plated fixing panel and fixtures such as bolts, which enable the fixing panel to be fixed to the both covers 140, 240.

Flexible hoses 300 having flexibilities, respectively are utilized in at least a portion of a pipe connecting between the inflow port 202*a* of the first heat exchanger 202 and the discharge port 102*a* of the first compressor 102 and in at least a portion of a pipe connecting between an outflow port 202*b* of the first heat exchanger 202 and an inflow port 104*a* of the first cooler 104. The flexible hose 300 is deformable in a direction orthogonal to a longitudinal direction thereof. Likewise, the flexible hoses 300 having flexibilities, respectively are utilized in at least a portion of a pipe connecting between the inflow port 204*a* of the second heat exchanger 204 and the discharge port 106*a* of the second compressor 106 and in at least a portion of a pipe connecting between an outflow port 204*b* of the second heat exchanger 204 and an inflow port 108*a* of the second cooler 108.

Next, the operation of the compression device of the present embodiment will be described.

First, gas is compressed in the first compressor 102. At this time, the temperature of the gas rises. This compressed gas flows from the discharge port 102*a* of the first compressor 102 through the flexible hose 300 and the inflow port 202*a* of the first heat exchanger 202 into the first heat exchanger 202. Then, after a heat exchange of the compressed gas with the working medium is made in the first heat exchanger 202 (after the working medium is heated by the compressed gas), the compressed gas flows from the outflow port 202*b* of the first heat exchanger 202 through the flexible hose 300 and the inflow port 104*a* of the first cooler 104 into the first cooler 104.

Then, the compressed gas that has been cooled in the first cooler 104 is further compressed by the second compressor 106. In the second compressor 106, the temperature of the gas rises. This compressed gas flows from the discharge port 106*a* of the second compressor 106 through the flexible hose 300 and the inflow port 204*a* of the second heat exchanger 204 into the second heat exchanger 204. Then, after a heat exchange of the compressed gas with the working medium is made in the second heat exchanger 204 (after the working medium is heated by the compressed gas), the compressed gas flows from the outflow port 204*b* of the second heat exchanger 204 through the flexible hose 300 and the inflow port 108*a* of the second cooler 108 into the second cooler 108. The compressed gas that has been cooled in the second cooler 108 is supplied to the outside.

Meanwhile, the working medium that has evaporated due to the heat exchange with the compressed gas in the first heat exchanger 202 and the second heat exchanger 204 flows in the oil separator 206. The working medium that has flowed out from the oil separator 206 flows in the expansion device 210. The working medium is expanded and thereby the expansion device 210 is driven; therefore, electric power is generated in the generator 212. The generated electric power is supplied, for example, to a motor for driving the first compressor 102 and the second compressor 106, various control devices such as a controller in the compression device body 100 and electromagnetic valves, and a pump for supplying oil, for example, to gears. Thus, the generated electric power serves as regenerative electric power to be consumed in the compression device. Note that the electric power may be partially utilized as power source for devices (for example, the pump 222 or the control devices) of the heat energy recovery unit 200 itself.

The working medium that has flowed out from the expansion device 210 is condensed in the condenser 214, thereafter flowing in the receiver 216 that is located below the condenser 214. The liquid-phase working medium that has flowed out from the receiver 216 flows in the pump 222, thereafter being pumped out by the pump 222 therefrom through the circulating flow passage 224 and the branch flow passage 226 to the first heat exchanger 202 and the second heat exchanger 204. As just described, the working medium circulates through the circulating flow passage 224 and the branch flow passage 226; thereby, the electric power generation is continued in the generator 212 during the operation of the compression device body 100.

As described above, in the compression device of the present embodiment, the first heat exchanger 202 is positioned closer to the first compressor 102 than the expansion device 210; therefore, a distance from the first compressor 102 to the first heat exchanger 202 is reduced. In addition, the inflow port 202*a* of the first heat exchanger 202 is oriented to face the first compressor 102. Consequently, the pipe connecting the first compressor 102 to the first heat exchanger 202 is inhibited from being excessively curved and bent. Likewise, the pipe to the second heat exchanger 204 is inhibited from being curved and bent. As a result, an effective recovery of heat energy included in the compressed gas by using the heat energy recovery unit 200 and a reduction of a pressure loss generated in the compressed gas that has been discharged from each of the compression devices 102, 106 can be achieved.

The first heat exchanger 202 is arranged on the forgoing opposite corner portion so that the direction into which the inflow port 202*a* is opened is oriented substantially in parallel with the rotor shaft of the first compressor 102. Therefore, the pipe connecting the first compressor 102 to the first heat exchanger 202 is further inhibited from being curved and bent. Consequently, a pressure loss generated in the compressed gas is further reduced. Likewise, a pressure loss of the compressed gas is reduced in the second heat exchanger 204.

In a compression device, members of a compression device body and a heat energy recovery unit are densely arranged; therefore, the assembly operation may be complicated. On the other hand, in the compression device of the present embodiment, before being mounted to the compression device body, the heat energy recovery unit 200 can be mounted on the second base plate 230; in other words, the heat energy recovery unit 200 can be unitized to the compression device body. As a result, the assembly operation of the compression device can be easily conducted. Likewise, in the following FIG. 4, the assembly operation of the compression device can be easily conducted.

The heat energy recovery unit 200 is provided on the base plate that is different from the base plate on which the compression device body 100 is provided. Therefore, in a factory or the like, the compression device body 100 and the heat energy recovery unit 200 are not necessary manufactured integrally. Consequently, an operation for subsequently mounting the heat energy recovery unit 200 to the compression device body 100 that may be singly used is easily performed. In addition, in the case of mounting the heat energy recovery unit 200 to the compression device body 100, the first cover 140 and the second cover 240 can be easily fixed by using the cover fixing member 340.

The expansion device 210 is arranged on the corner portion of the second base plate 230. Accordingly, for example, a window for working is provided in a lateral surface of the second cover 240, which enables an easy access from the outside of the second base plate 230 to the expansion device 210. Therefore, an operation, for example, for doing maintenance on the expansion device 210 can be easily conducted. In addition, the expansion device 210 is mounted on the mounting stand 213; thereby, the height of the expansion device 210 can be secured. As a result, the expansion device 210 can be easily hoisted with a crane and therefore an operation of carrying the expansion device 210 in or out of the heat energy recovery unit 200 is easily conducted.

The pump 222 is positioned above and separated from the second base plate 230 and is arranged so that the oil supply port 222*b* is oriented downward, and the oil supply flow passage 223 is connected to the oil supply port 222*b* while being arranged below the pump 222. Therefore, the size of the heat energy recovery unit 200 can be reduced in the horizontal direction.

The pipe connecting the compression device body 100 to the heat energy recovery unit 200 includes the flexible hose 300. Therefore, the misalignment of the inflow port 202*a* of the first heat exchanger 202 to the discharge port 102*a* of the first compressor 102 and the misalignment of the inflow port 204*a* of the second heat exchanger 204 to the discharge port 106*a* of the second compressors 106 are prevented, while these inflow ports 202*a*, 204*a* can be surely connected to the discharge ports 102*a*, 106*a*. Likewise, misalignment between the first heat exchanger 202 and the first cooler 104 and misalignment between the second heat exchanger 204 and the second cooler 108 are prevented, while secure connections are established.

Figure 4:
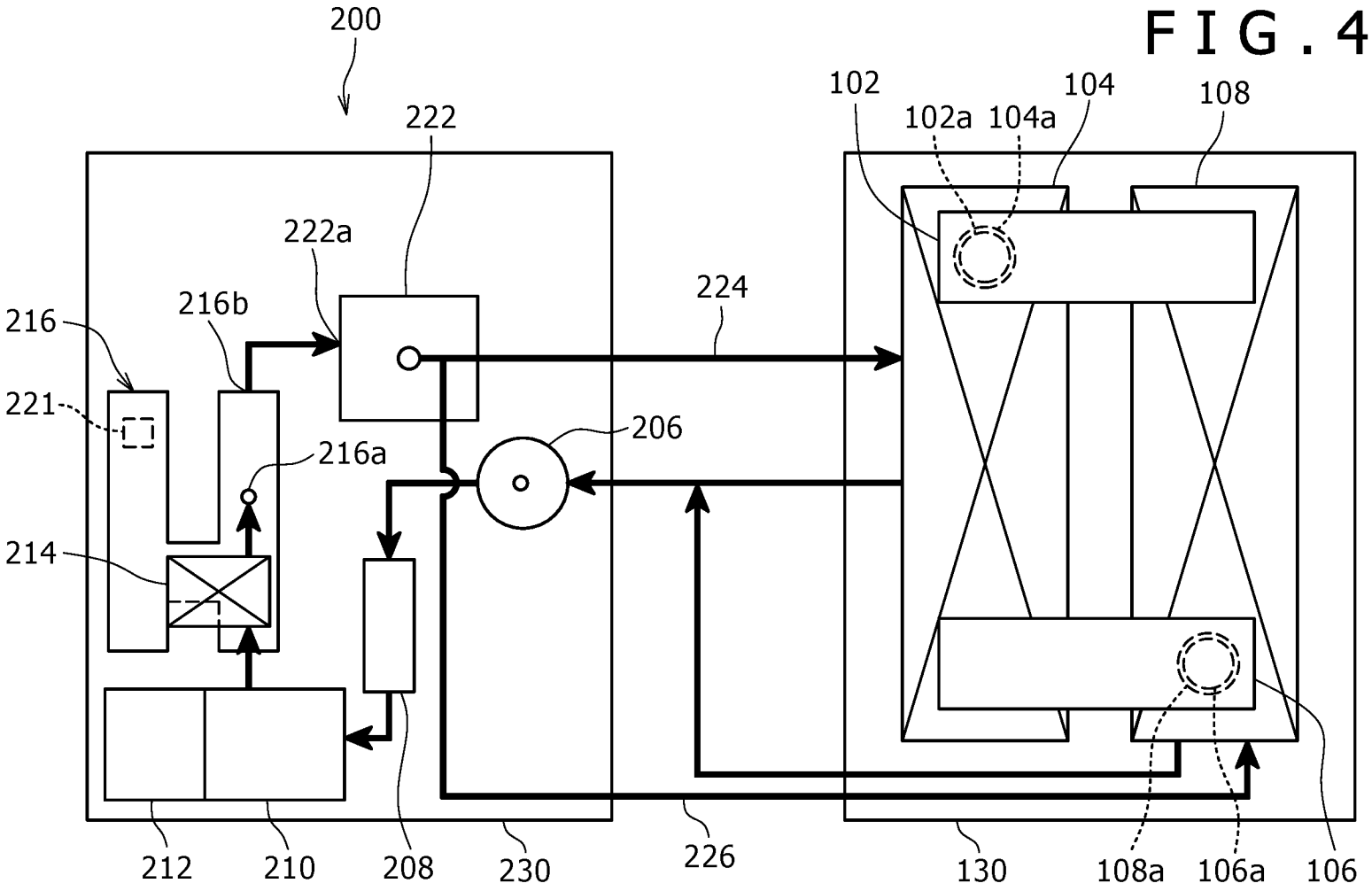
FIG. 4 is a plan view showing another example of the compression device.

FIG. 4 is a drawing showing another example of the compression device. In FIG. 4, the heat exchangers 202, 204 are not provided on the second base plate 230. In the heat energy recovery unit 200, a portion of the circulating flow passage 224, to which the first heat exchanger 202 is connected, is connected to the first cooler 104, and a portion of the circulating flow passage 224, to which the second heat exchanger 204 is connected, is connected to the second cooler 108. In the first and second coolers 104, 108, flow passages through which the working medium flows and flow passages through which cooling fluid (not shown) flows are formed, and therefore the compressed gas is cooled by the working medium and the cooling fluid. As just described, in the compression device, the coolers 104, 108 fill the roles of the heat exchangers 202, 204 of the heat energy recovery unit 200.

The compressed gas inflow port 104*a* of the first cooler 104 is oriented so as to face the compressed gas discharge port 102*a* of the first compressor 102 in the gravity direction. Likewise, the compressed gas inflow port 108*a* of the second cooler 108 is oriented so as to face the compressed gas discharge port 106*a* of the second compressor 106 in the gravity direction. Other configurations of the compression device are similar to those in FIG. 1.

Likewise, in the case of FIG. 4, the coolers 104, 108 are positioned closer to the first compressor 102 and the second compressor 106 than the expansion device 210, and the compressed gas inflow ports 104*a*, 108*a* of the coolers 104, 108 face the first and second compressors 102, 106, respectively; therefore, a pressure loss generated in the compressed gas can be reduced. Further, a heat exchange of the working medium with the compressed gas is made in the coolers 104, 108; in other words, the coolers 104, 108 fill the roles of the heat exchangers 202, 204 of the heat energy recovery unit 200. Therefore, the pressure loss of the compressed gas can be further reduced.

Figure 5:
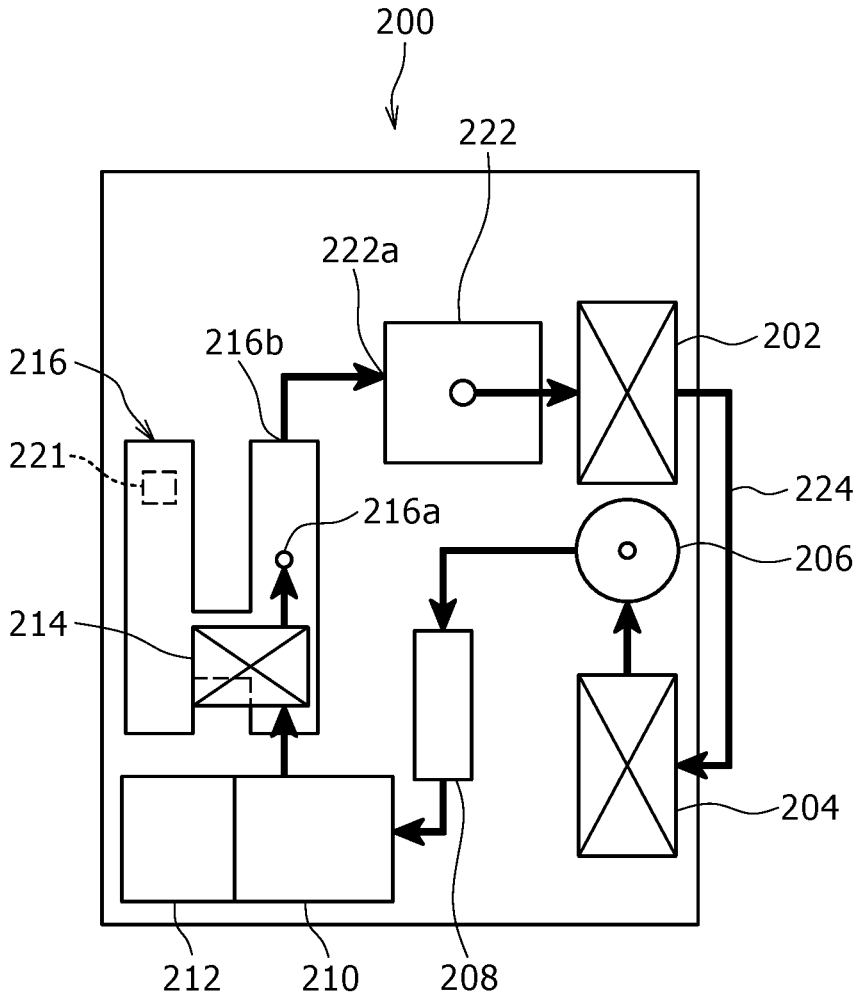
FIG. 5 is a plan view showing still another example of the compression device.

FIG. 5 is a drawing showing still another example of the compression device. In the heat energy recovery unit 200, the first heat exchanger 202 and the second heat exchanger 204 are arranged in series with each other in the circulating flow passage 224, and the working medium that has flowed out from the first heat exchanger 202 flows in the second heat exchanger 204. The working medium that has been heated in the first heat exchanger 202 and the second heat exchanger 204 flows through the oil separator 206 and the urgent shut-off valve 208 into the expansion device 210, therefore driving the expansion device 210 and the generator 212. Other configurations of the compression device are similar to those in FIG. 1. In the compression device shown in FIG. 5, the working medium flowing in the first heat exchanger 202 is the same volume as in the second heat exchanger 204; therefore, an operation for adjusting the volume of distribution of the working medium to the first and second heat exchangers 202, 204 in a parallel structure will not be necessary. In the compression device of FIG. 4, the coolers 104, 108 may be arranged in series with each other in the circulating flow passage 224.

Figure 6:
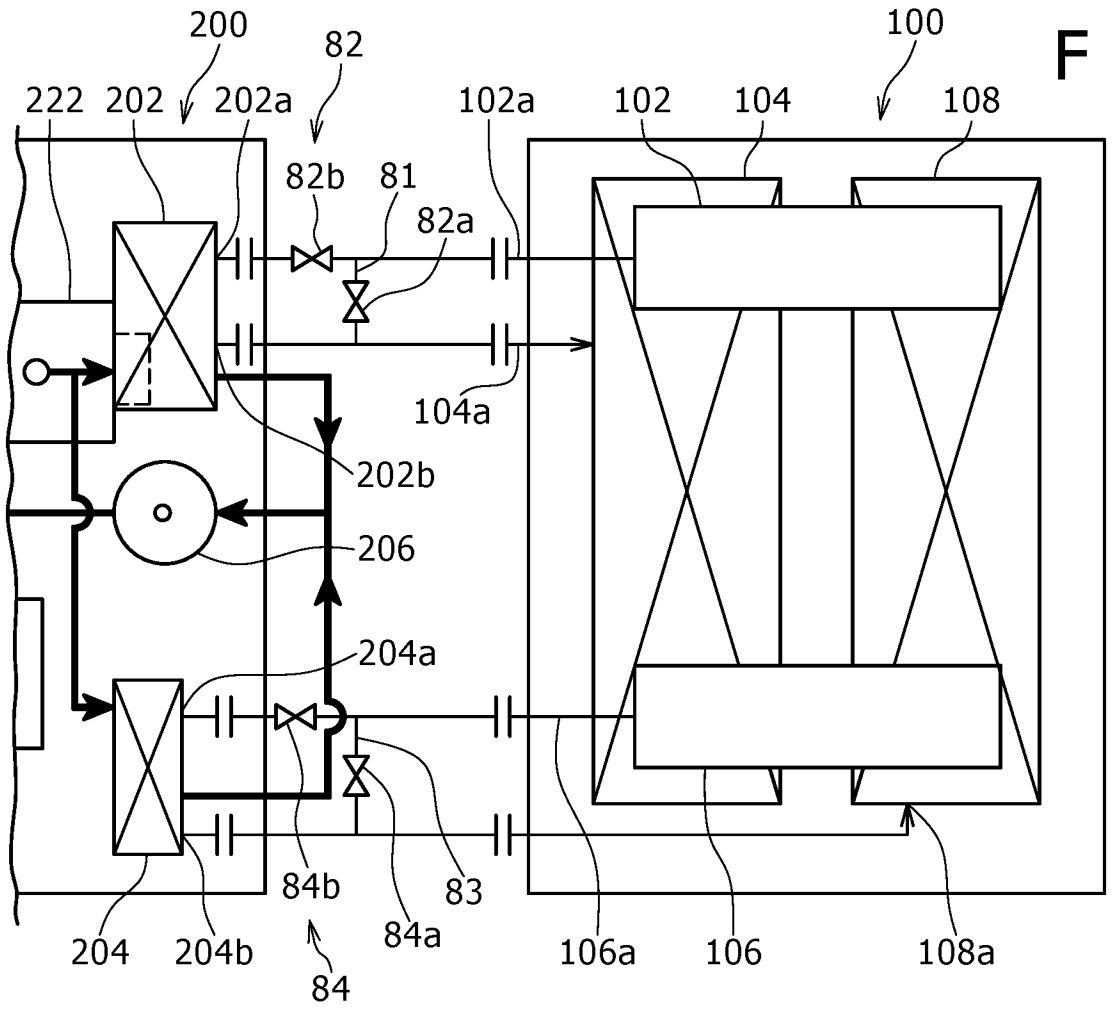
FIG. 6 is a plan view showing still another example of the compression device.

FIG. 6 is a drawing showing still another example of the compression device. The compression device body 100 includes a first bypass flow passage 81, a first valve member 82, a second bypass flow passage 83, and a second valve member 84 in a flow passage of the compressed gas. Other configurations are similar to those in FIG. 1.

The first bypass flow passage 81 connects a portion of the flow passage between the discharge port 102*a* of the first compressor 102 and the inflow port 202*a* of the first heat exchanger 202 to a portion of the flow passage between the outflow port 202*b* of the first heat exchanger 202 and the inflow port 104*a* of the first cooler 104. The first valve member 82 includes two valves 82*a*, 82*b*. The valve 82*a* is provided in the first bypass flow passage 81. The valve 82*a* is normally closed. The valve 82*b* is located downstream of the connected portion of the flow passage between the discharge port 102*a* of the first compressor 102 and the inflow port 202*a* of the first heat exchanger 202, with the first bypass flow passage 81. The valve 82*b* is normally open. During the operation of the compression device, the first valve member 82 allows the compressed gas to flow into the first heat exchanger 202 and restricts the compressed gas from flowing into the first bypass flow passage 81.

The second bypass flow passage 83 connects a portion of the flow passage between the discharge port 106*a* of the second compressor 106 and the inflow port 204*a* of the second heat exchanger 204 to a portion of the flow passage between the outflow port 204*b* of the second heat exchanger 204 and the inflow port 108*a* of the second cooler 108. The second valve member 84 includes two valves 84*a*, 84*b*. The valve 84*a* is provided in the second bypass flow passage 83. The valve 84*a* is normally closed. The valve 84*b* is located downstream of the connected portion of the flow passage between the discharge port 106*a* of the second compressor 106 and the inflow port 204*a* of the second heat exchanger 204, with the second bypass flow passage 83. The valve 84*b* is normally open. During the operation of the compression device, the second valve member 84 allows the compressed gas to flow into the second heat exchanger 204 and restricts the compressed gas from flowing into the second bypass flow passage 83.

In the compression device, when there has been a defect in the heat energy recovery unit 200, the first valve member 82 is switched; thereby, the compressed gas that has been discharged from the first compressor 102 is restricted from flowing in the first heat exchanger 202 and the compressed gas flows through the first bypass flow passage 81 into the first cooler 104 that is located downstream of the first heat exchanger 202. Likewise, the second valve member 84 is switched; thereby, the compressed gas that has been discharged from the second compressor 106 is restricted from flowing in the second heat exchanger 204 and the compressed gas flows through the second bypass flow passage 83 into the second cooler 108 that is located downstream of the second heat exchanger 204. The supply of the compressed gas to the first heat exchanger 202 and the second heat exchanger 204 is stopped and thereby the electric power generation is stopped.

Here, whether or not there has been a defect in the heat energy recovery unit 200 is determined by at least one of the pressure or temperature of the working medium flowing in the expansion device 210, the number of rotations of the expansion device 210 or the generator 212, the frequency of electric power output from the generator 212, and the internal temperature of the generator 212. Further, in a case where the liquid level inside the receiver 216 has reached a value below a predetermined value, a case where a signal indicating a failure of an electronic device, for example, an inverter or a converter which is associated with the generator 212 has been detected in a control unit of the compression device, and a case where an emergency stop has been commanded by an operator, a determination of the occurrence of the defect is made.

In the compression device shown in FIG. 6, the first and second bypass flow passages 81, 83 are provided; thereby, when there has been a defect in the heat energy recovery unit 200, the heat energy recovery unit 200 can be promptly stopped and an inspection or the like of the compression device can be conducted. In addition, even in a state where the operation of the heat energy recovery unit 200 is stopped, the compression device body 100 can continue to be driven.

Note that the embodiment disclosed here is provided for the purposes of illustration in all respects and should not be regarded as limitation. The scope of the present invention is indicated not by the explanation of the aforementioned embodiment but by the claims, and the scope of the present invention may include all changes within the meaning and scope that are equivalent to the claims.

Figure 7:
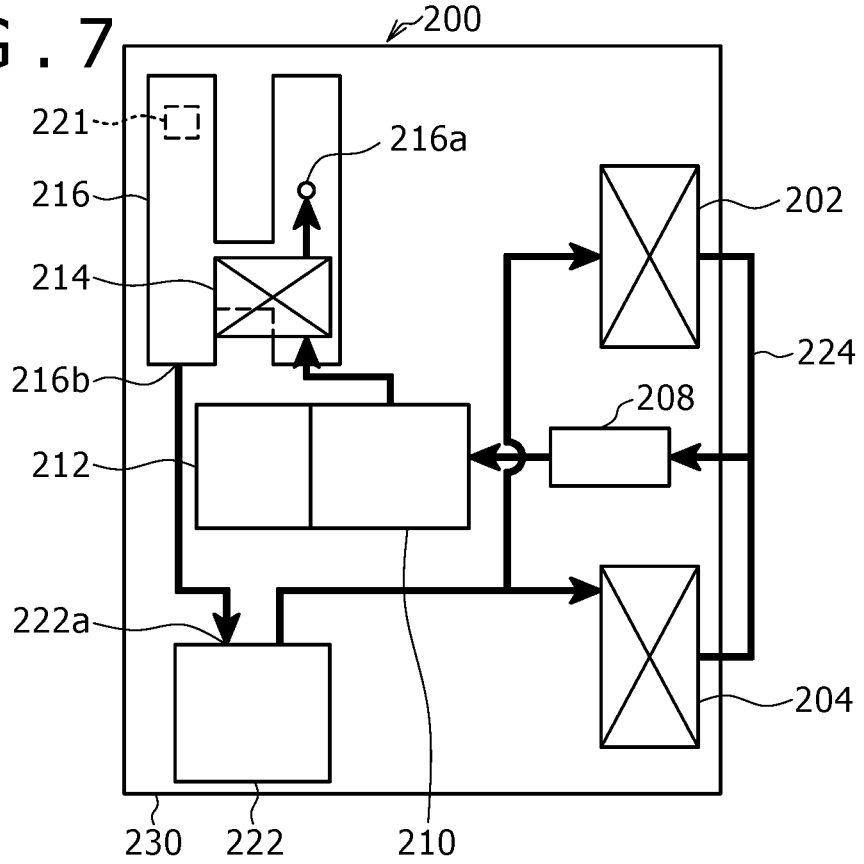
FIG. 7 is a plan view showing another example of the heat energy recovery unit.

FIG. 7 is a drawing showing another example of the heat energy recovery unit 200. In the heat energy recovery unit 200, the expansion device 210 and the generator 212 are arranged in the substantially center in the width direction of the second base plate 230 (in the up to down direction in FIG. 7). Here, the width direction is a direction that is perpendicular to the direction in which the heat energy recovery unit 200 and the compression device body 100 of FIG. 1 are arranged in the horizontal surface. The condenser 214 and the receiver 216, and the pump 222 are arranged on the respective sides of the expansion device 210 and the generator 212 as viewed in the width direction. Other configurations are similar to those in FIG. 1. In the heat energy recovery unit 200, the expansion device 210 is arranged on the mounting stand 213 in the same way as in FIG. 2. Thus, the height of the expansion device 210 can be secured, and the expansion device 210 can be easily hoisted with a crane and therefore the expansion device 210 can be easily carried in and out of the heat energy recovery unit 200.

Figure 8:
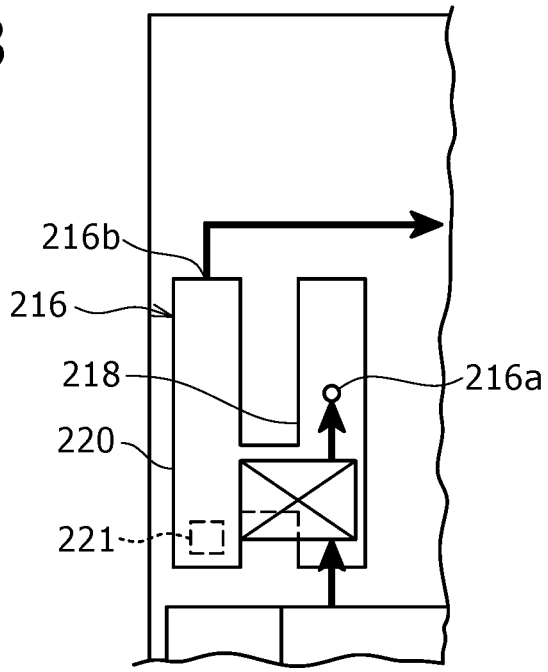
FIG. 8 is a side view showing another example of a receiver.

FIG. 8 is a drawing showing another example of the receiver 216. In FIG. 8, the working medium outflow port 216*b* is provided in the second tubular portion 220. The liquid level sensor 221 is provided on the opposite side of the outflow port 216*b* of the second tubular portion 220. Even in this case, a detected value by the liquid level sensor 221 may be inhibited from changing due to fluctuations in the liquid surface, which are caused by the inflow of the working medium into the first tubular portion 218.

Figure 9:
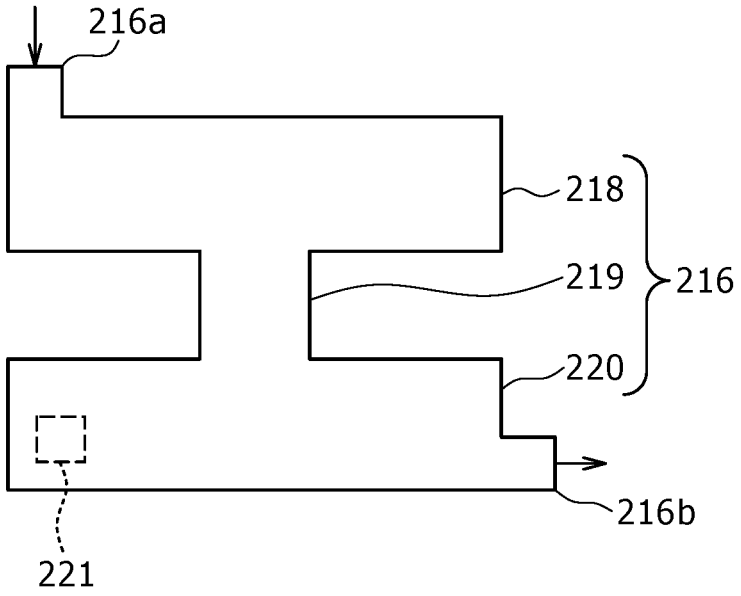
FIG. 9 is a side view showing still another example of the receiver.

In the aforementioned embodiment, an example in which the tubular portions 218, 220 of the receiver 216 are oriented in parallel with each other in the horizontal surface is provided; however, the orientation of the receiver 216 is not limited thereto. As shown in FIG. 9, the receiver 216 may be arranged so that the first tubular portion 218 and the second tubular portion 220 are aligned in the up to down direction along a surface that is perpendicular to the horizontal surface. In this case, the inflow port 216*a* is provided in an upper portion of the first tubular portion 218 and the outflow port 216*b* is provided in a lower portion of the second tubular portion 220. In addition, the fluid level sensor 221 is provided within the second tubular portion 220. In this configuration, the liquid-phase working medium is stored in the second tubular portion 220 located at the lower side, and in addition, the second tubular portion 220 is provided with the outflow port 216*b*; therefore, the outflow of gas from the outflow port 216*b* is inhibited.

Figure 10:
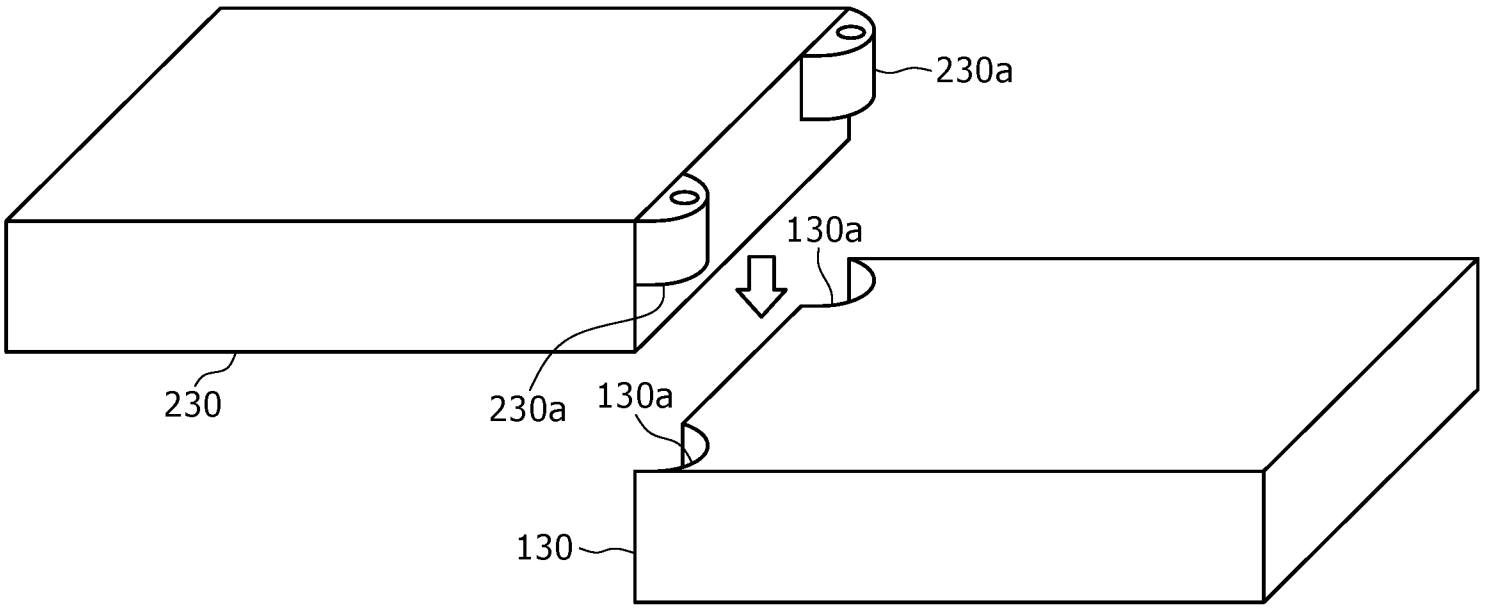
FIG. 10 is a perspective view showing a modified example of a first base plate and the second base plate.

In the aforementioned embodiment, an example in which the first base plate 130 and the second base plate 230 are fixed by the base plate fixing member 330; however, a method for fixing these base plates are not limited thereto. For example, as shown in FIG. 10, recessed portions 130*a* may be provided in a portion of the first base plate 130, which is to face the second base plate 230, and protruded portions 230*a* to be fit in the recessed portions 130*a* may be provided at the second base plate 230.

In the embodiment shown in FIG. 1, if the inflow port 202*a* of the first heat exchanger 202 faces the compressor body of the first compressor 102 in planar view; in other words, if the compressor body of the first compressor 102 exists in the direction into which the inflow port 202*a* is opened, the inflow port 202*a* may not necessarily face the discharge port 102*a* of the first compressor 102. Even in such a case, the pipe connecting the first compressor 102 to the first heat exchanger 202 is inhibited from being excessively curved and bent, therefore reducing a pressure loss generated in the compressed gas. Likewise, the pipe between the second heat exchanger 204 and the compressor body of the second compressor 106 is inhibited from being curved and bent and therefore a pressure loss of the compressed gas is reduced.

In the embodiment shown in FIG. 4, if the inflow port 104*a* of the first cooler 104 faces the first compressor 102 in the gravity direction; in other words, if the first compressor 102 exists in a direction into which the inflow port 104*a* is opened, the inflow port 104*a* may not necessarily face the discharge port 102*a* of the first compressor 102. A pipe connecting the first compressor 102 to the first cooler 104 is inhibited from being excessively curved and bent. Likewise, a pipe between the second cooler 108 and the second compressor 106 is inhibited from being curved and bent.

In the aforementioned embodiment, the suction port 222*a* of the pump 222 may be arranged below the outflow port 216*b* of the receiver 216 in the gravity direction. The outflow port 216*b* is located on the same level as the suction port 222*a* of the pump 222 or above the suction port 222*a* in the gravity direction; thereby, the inflow of gas into the pump 222 is inhibited.

In a case where a space is secured around the pump 222, the oil supply port 222*b* may be arranged at the lateral side of the pump 222. In addition, grease may be used for lubricating various components of the pump 222. In this case, the oil supply flow passage 223 will be omitted.

If the compression device body 100 and the heat energy recovery unit 200 are accurately positioned, the compression device body 100 and the heat energy recovery unit 200 may be connected by a steel pipe, which does not have flexibility, as a substitute for the flexible hose 300.

In the aforementioned embodiment, if a portion for storing the liquid-phase working medium is provided within the condenser 214, the receiver 216 may be omitted. If oil is not used, for example, for lubricating various components of the expansion device 210, in specific, for example, if the expansion device 210 is an oil-free expansion device and a magnetic bearing is applied as a bearing, the oil separator 206 may be omitted. Further, if oil is used for lubricating the bearing or the like even in the oil-free expansion device, an oil supply system provided with an oil pump, an oil tank, a cooler, or the like is separately provided. As described above, if the first and second coolers 104, 108 fill the rolls of the first and second heat exchangers 202, 204, the heat exchangers are not provided on the second base plate 230. As just described, in the compression device, at least the expansion device 210, the power recovery unit 212, the condenser 214, and the pump 222 are provided on the second base plate 230; thereby, a system to recover heat energy from the compressed gas can be configured.

In the compression device shown in FIG. 6, the first valve member 82 and the second valve member 84 may be formed by a single selector valve. In the heat energy recovery unit 200, a drive device other than a generator may be applied as a power recovery unit. A method to reduce a pressure loss of the compressed gas may be applied to a compression device, which includes only one compressor. Alternatively, the method may be applied to a compression device, which includes three or more compressors.

Here, the aforementioned embodiment will be outlined.

A compression device according to an aspect of the present invention includes a compressor for compressing gas and a heat energy recovery unit for recovering heat energy of the gas that has been compressed in the compressor and discharged therefrom, the heat energy recovery unit including: a heat exchanger including an inflow port for allowing inflow of the compressed gas, the heat exchanger for heating a working medium by heat of the compressed gas; an expansion device for expanding the working medium that has flowed out from the heat exchanger; a power recovery unit connected to the expansion device; a condenser for condensing the working medium that has flowed out from the expansion device; and a pump for pumping the working medium that has flowed out from the condenser, to the heat exchanger, wherein the heat exchanger is positioned closer to the compressor than the expansion device and is arranged so that the inflow port is oriented to face the compressor.

In the compression device, the heat exchanger is positioned closer to the compressor than the expansion device; therefore, a distance from the compressor to the heat exchanger is reduced. In addition, the compressed gas inflow port of the heat exchanger is oriented to face the compressor; therefore, a pipe connecting the compressor to the heat exchanger is inhibited from being curved and bent. Consequently, an effective recovery of heat energy included in the compressed gas by using the heat energy recovery unit and a reduction of a pressure loss generated in the compressed gas can be achieved.

In such a case, the compression device may preferably further include: a first base plate above which the compressor is arranged; and a second base plate above which at least the expansion device, the power recovery unit, the condenser, and the pump out of the heat energy recovery unit are arranged.

In the compression device, in order to inhibit a pressure loss of the compressed gas, the heat exchanger may preferably be positioned close to the compressor. However, various members are densely arranged around the compressor; therefore, if the heat exchanger is brought closer to the compressor, various members of the heat energy recovery unit may interfere with the members around the compressor at the time of assembling of the compression device. Thus, according to this aspect, in a state where the members are positionally fixed relative to each other, the heat energy recovery unit is mounted on the second base plate; in other words, the heat energy recovery unit is unitized. As a result, at the time of assembling of the compression device, the heat exchanger can be brought closer to the compressor while the members of the heat energy recovery unit are inhibited from interfering with the members around the compressor.

Specifically, it is preferable that the second base plate have a substantially rectangular shape and that the expansion device be arranged on a corner portion of the second base plate.

With the structure as just described, the expansion device may be easily accessed from the outside of the second base plate; therefore, the maintenance of the expansion device is easily performed.

Further, the compression device may preferably further include a mounting stand by which the expansion device is mounted above the second base plate.

Since the expansion device is mounted on the mounting stand, the height of the expansion device is secured. Therefore, various operations, for example, for performing maintenance on the expansion device and attaching the expansion device to the heat energy recovery unit are easily performed. In addition, the expansion device may be easily hoisted with a crane and therefore an operation for carrying the expansion device in or out of the heat energy recovery unit is easily conducted.

Furthermore, the compression device may preferably further include a base plate fixing member by which the second base plate and the first base plate are positionally fixed relative to each other.

According to this aspect, misalignment between the inflow port of the heat exchanger and the discharge port of the compressor due to misalignment between the first base plate and the second base plate is prevented.

Still further, in the compression device, the heat energy recover unit may preferably further include an oil supply flow passage for supplying oil to the pump. Preferably, the pump includes an oil supply port that is connected to the oil supply flow passage, and the pump is positioned above and separated from the second base plate and is arranged so that the oil supply port is oriented to face downward. The oil supply flow passage may preferably be connected to the oil supply port while being arranged below the pump.

According to this aspect, the size of the heat energy recovery unit can be minimized in the horizontal direction.

Further, the compression device may preferably further include a first cover for covering the compressor, a second cover for covering the heat energy recovery unit, and a cover fixing member by which the second cover and the first cover are positionally fixed relative to each other.

The cover fixing member is provided; thereby, in the case of subsequently mounting the heat energy recovery unit to the compressor that may be singly used, the first cover and the second cover are easily mounted to the compressor and the heat energy recovery unit, respectively.

Furthermore, it is preferable that the compression device further include a pipe by which the inflow port of the heat exchanger is connected to a discharge port of the compressor and that the pipe include a flexible hose having flexibility.

According to this aspect, the misalignment between the inflow port of the heat exchanger and the discharge port of the compressor can be inhibited while the inflow port and the discharge port are connected to each other.

Still further, in the compression device, the heat energy recovery unit may preferably further include a receiver for storing the working medium that has flowed out from the condenser. Preferably, the receiver includes an outflow port for allowing outflow of the working medium, and the pump includes a suction port for suctioning the working medium. The outflow port of the receiver may preferably be arranged on the same level as the suction port of the pump or above the suction port in the gravity direction.

According to this aspect, the suction port of the pump is filled with the liquid-phase working medium; therefore, the inflow of gas into the pump is inhibited. Further, a portion of the receiver, which is located lower in the gravity direction than the suction port of the pump can be reduced (it is difficult that the working medium is suctioned from the portion by the pump); therefore, a total volume of the working medium to be stored in the receiver can be reduced.

In such a case, preferably, the receiver includes an inflow port for allowing inflow of the working medium, and the condenser includes an outflow port for allowing outflow of the working medium. The inflow port of the receiver may preferably be located below the outflow port of the condenser in the gravity direction.

According to this aspect, the working medium that has flowed out from the condenser can be effectively stored in the receiver.

Further, in the compression device, the receiver may preferably include two tubular portions that are arranged in a horizontal surface and are shaped to communicate with each other. Preferably, one tubular portion of the two tubular portions includes an inflow port for allowing the working medium that has flowed out from the condenser, to flow in the tubular portion, and the other tubular portion of the two tubular portions is provided with a liquid level sensor for detecting a liquid level of the working medium.

According to this aspect, a position at which the liquid level sensor is provided is separated from the position of the working medium inflow port. Therefore, a detected value by the liquid level sensor may be inhibited from changing due to fluctuations in a liquid surface within the one tubular portion, which are caused when the working medium flows through the inflow port into the one tubular portion to impact against the liquid surface.

Alternatively, the receiver may preferably include two tubular portions that are arranged to be separated from each other in an up to down direction and are shaped to communicate with each other. Preferably, one tubular portion of the two tubular portions, which is located at an upper side, includes an inflow port for allowing the working medium that has flowed out from the condenser, to flow in the tubular portion, and the other tubular portion of the two tubular portions, which is located at a lower side, includes the outflow port.

According to this aspect, the liquid-phase working medium is stored in the tubular portion located at the lower side, and in addition, the tubular portion is provided with the outflow port; therefore, the outflow of gas from the outflow port is inhibited.

Furthermore, in the compression device, the compressor may preferably include a rotary shaft for driving a compression member. Preferably, the heat exchanger is arranged so that a direction into which the inflow port of the heat exchanger is opened is oriented substantially in parallel with an axial direction of the rotary shaft.

With the structure just described, the pipe connecting the compressor to the heat exchanger is further inhibited from being curved and bent, thereby further reducing a pressure loss generated in the compressed gas.

Still further, in the compression device, a flow passage through which the compressed gas flows may preferably be provided with a bypass flow passage for bypassing the heat exchanger. Preferably, when there has been a defect in the heat energy recovery unit, a flow of the compressed gas toward the heat exchanger is inhibited and the compressed gas is allowed to pass through the bypass flow passage and flow downstream of the heat exchanger.

Accordingly, when there has been a defect in the heat energy recovery unit, the operation of the power recovery unit can be promptly stopped and an inspection or the like of the compression device can be conducted. In addition, even in a state where the heat energy recovery unit is stopped, the compression device can continue to be driven.

Moreover, the compression device may preferably further include: a different compressor that is different from the compressor, the different compressor for further compressing the compressed gas that has flowed out from the heat exchanger; and a different heat exchanger including a different inflow port for allowing inflow of the compressed gas that has flowed out from the different compressor, the different heat exchanger for heating the working medium by heat of the compressed gas. Preferably, the different heat exchanger is positioned closer to the different compressor than the expansion device and is arranged so that the different inflow port is oriented to face the different compressor.

According to this aspect, a pressure loss generated in the compressed gas can be effectively reduced while heat energy included in the compressed gas is further recovered by the heat energy recovery unit.

The invention claimed is:

1. A compression device, comprising:

a compressor for compressing gas;

a heat energy recovery unit for recovering heat energy of the gas that has been compressed in the compressor and discharged therefrom; and a first base plate above which the compressor is arranged, the heat energy recovery unit comprising:

a heat exchanger including an inflow port for allowing inflow of the compressed gas, the heat exchanger for heating a working medium by heat of the compressed gas;

an expansion device for expanding the working medium that has flowed out from the heat exchanger;

a power recovery unit connected to the expansion device;

a condenser for condensing the working medium that has flowed out from the expansion device; and a pump for pumping the working medium that has flowed out from the condenser, to the heat exchanger, the compression device further comprising:

a second base plate above which at least the expansion device, the power recovery unit, the condenser, and the pump out of the heat energy recovery unit are arranged, wherein the heat exchanger is positioned closer to the compressor than the expansion device and is arranged so that the inflow port is oriented to face the compressor.

2. The compression device according to claim 1, wherein the second base plate has a rectangular shape, and wherein the expansion device is arranged on a corner portion of the second base plate.

3. The compression device according to claim 1, further comprising a mounting stand by which the expansion device is mounted above the second base plate.

4. The compression device according to claim 1, further comprising a base plate fixing member by which the second base plate and the first base plate are positionally fixed relative to each other.

5. The compression device according to claim 1, wherein the heat energy recovery unit further includes an oil supply flow passage for supplying oil to the pump, wherein the pump includes an oil supply port that is connected to the oil supply flow passage, and the pump is positioned above and separated from the second base plate and is arranged so that the oil supply port is oriented to face downward, and wherein the oil supply flow passage is connected to the oil supply port while being arranged below the pump.

6. The compression device according to claim 1, further comprising:

a first cover for covering the compressor;

a second cover for covering the heat energy recovery unit; and a cover fixing member by which the second cover and the first cover are positionally fixed relative to each other.

7. The compression device according to claim 1, further comprising a pipe by which the inflow port of the heat exchanger is connected to a discharge port of the compressor, the pipe including a flexible hose having flexibility.

8. The compression device according to claim 1, wherein the heat energy recovery unit further includes a receiver for storing the working medium that has flowed out from the condenser, wherein the receiver includes an outflow port for allowing outflow of the working medium, wherein the pump includes a suction port for suctioning the working medium, and wherein the outflow port of the receiver is arranged on the same level as the suction port of the pump or above the suction port in the gravity direction.

9. The compression device according to claim 8, wherein the receiver includes an inflow port for allowing inflow of the working medium, wherein the condenser includes an outflow port for allowing outflow of the working medium, and wherein the inflow port of the receiver is located below the outflow port of the condenser in the gravity direction.

10. The compression device according to claim 8, wherein the receiver includes two tubular portions that are arranged in a horizontal surface and are shaped to communicate with each other, and wherein one tubular portion of the two tubular portions includes an inflow port for allowing the working medium that has flowed out from the condenser, to flow in the tubular portion, and the other tubular portion of the two tubular portions is provided with a liquid level sensor for detecting a liquid level of the working medium.

11. The compression device according to claim 8, wherein the receiver includes two tubular portions that are arranged to be separated from each other in an up to down direction and are shaped to communicate with each other, and wherein one tubular portion of the two tubular portions, which is located at an upper side, includes an inflow port for allowing the working medium that has flowed out from the condenser, to flow in the tubular portion, and the other tubular portion of the two tubular portions, which is located at a lower side, includes the outflow port.

12. The compression device according to claim 1, wherein the compressor includes a rotary shaft for driving a compression member, and wherein the heat exchanger is arranged so that a direction into which the inflow port of the heat exchanger is opened is oriented in parallel with an axial direction of the rotary shaft.

13. The compression device according to claim 1, wherein a flow passage through which the compressed gas flows is provided with a bypass flow passage for bypassing the heat exchanger, and wherein when there has been a defect in the heat energy recovery unit, a flow of the compressed gas toward the heat exchanger is inhibited and the compressed gas is allowed to pass through the bypass flow passage and flow downstream of the heat exchanger.

14. The compression device according to claim 1, further comprising:

a different compressor that is different from the compressor, the different compressor for further compressing the compressed gas that has flowed out from the heat exchanger; and a different heat exchanger including a different inflow port for allowing inflow of the compressed gas that has been discharged from the different compressor, the different heat exchanger for heating the working medium by heat of the compressed gas, the different heat exchanger being positioned closer to the different compressor than the expansion device and being arranged so that the different inflow port is oriented to face the different compressor.

* * * * *